US005257707A

United States Patent [19]

Soede

[11] Patent Number: 5,257,707

[45] Date of Patent: Nov. 2, 1993

[54] COLLAPSIBLE CONTAINER

[75] Inventor: Antje E. Soede, Amsterdam, Netherlands

[73] Assignee: Koninklijke Emballage Industrie Van Leer B.V., Amstelveen, Netherlands

[21] Appl. No.: 910,293

[22] PCT Filed: Jan. 7, 1991

[86] PCT No.: PCT/NL91/00003

§ 371 Date: Aug. 26, 1992

§ 102(e) Date: Aug. 26, 1992

[87] PCT Pub. No.: WO91/10608

PCT Pub. Date: Jul. 25, 1991

[30] Foreign Application Priority Data

Jan. 18, 1990 [NL] Netherlands ..... 9000124

[51] Int. Cl.[5] ..... B65D 5/12

[52] U.S. Cl. ..... 220/4.29; 220/6; 206/597

[58] Field of Search ..... 220/6, 4.29, 7; 206/386, 597

[56] References Cited

U.S. PATENT DOCUMENTS

| | | | |
|---|---|---|---|
| 3,130,850 | 4/1964 | Oakey et al. . | |
| 3,354,924 | 11/1967 | Birrell et al. . | |
| 4,014,292 | 3/1977 | Coughlin et al. | 220/6 |
| 4,585,159 | 4/1986 | Travis | 220/6 |
| 4,694,986 | 9/1987 | Chou | 220/6 |
| 4,878,682 | 11/1989 | Lee | 220/6 |

FOREIGN PATENT DOCUMENTS 3533561 4/1987 Fed. Rep. of Germany .

*Primary Examiner*—Joseph Man-Fu Moy
*Attorney, Agent, or Firm*—Young & Thompson

[57] ABSTRACT

A collapsible container has a bottom panel (1) and at least three hingedly interconnected faces (3–6) which are collapsible on the bottom panel (1). At least two interconnected faces (4–6) are composed of hingedly interconnected rigid face halves (7,8) which are separated from each other along a diagonal hinge line (9). According to an embodiment, three faces (4–5) are made up of hingedly interconnected face halves (7,8) and a fourth rigid face (3) is hingedly connected to a face at the free edge (11) thereof.

5 Claims, 4 Drawing Sheets

COLLAPSIBLE CONTAINER

BACKGROUND OF THE INVENTION

The present invention relates to a collapsible parallelepipedic container. Such containers are known from U.S. Pat. No. 3,354,924. This known container has faces which are hingedly interconnected. In order to allow the processes of folding up or opening out of this known container to be carried out, its walls should consist of a flexible material. This is caused by the fact that during these processes the in-plane geometry of the walls is changing.

The necessity of having flexible walls makes that these containers are only suitable for relatively light and small packages. For larger packages and heavier loads the walls should be stiff enough to prevent bulging out. However, in that case the container would no longer be collapsible.

SUMMARY OF THE INVENTION

The object of the invention is therefore to provide a container of the type mentioned in the introduction which is also suitable for larger packages and heavier loads. This is achieved by a parallelepipedic container having a bottom panel (1) which is hingedly connected to one of three hingedly interconnected side faces (4–6) which are collapsible onto said bottom panel (1), each of said three hingedly interconnected side faces being composed of face halves (7, 8) which are hingedly interconnected along a diagonal hinge (9, 24, 25) in such a way that said side faces (4–6) are foldable with respect to said diagonal hinges (9, 24, 25), whereby the diagonal hinge lines of any two neighbouring faces (4–6) do not meet at their respective end, and having a fourth rigid side face (3) which is hingedly connected (11) to one of said three side faces (4–6) and which at its opposite edge is detachably connected (27) to the corresponding free opposite edge of another of said faces.

Once opened out, the container according to the invention affords a stable unit which is suitable for carrying heavy loads. Furthermore, the three interconnected faces open out as soon as one of them is erected. The advantage of this is that the stable unit, which can be handled without further aid by one person, is immediately obtained.

In order to improve the stability of the container, and in particular of the opened-out faces, provision can be made for one or more of the three faces to be provided on the inside with a stop which is provided on one face part and projects relative to the appropriate diagonal, and which in the position of the face halves in which they form one plane rests against the other face half. In the case of this embodiment it is easily possible to make the faces of corrugated cardboard. The stop prevents the corrugated cardboard faces from bulging outwards.

In particular the container should provide a reliable and stable support for a plastic bag filled with liquid or powdered materials. In this connection the detachable connections of the faces to each other constitute a risk factor. Once one of those connections comes off, the support for the plastic bag is in fact partially lost, in such a way that said bag could tear.

In this connection, according to a preferred embodiment of the invention, the fourth rigid face at its opposite edge is provided with a fixing strip (27) extending along the free edge of said face (3), said fixing strip being fixable to the said corresponding side face of said opposite side faces (4–6).

This fourth face can now be connected in the opened-out position to the opposite face, so that an outer which is closed all the way round is obtained. As already mentioned, only one connecting action need be carried out here, which favourably affects the reliability of the opened-out container.

DETAILED DESCRIPTION OF THE INVENTION

Figure 1:
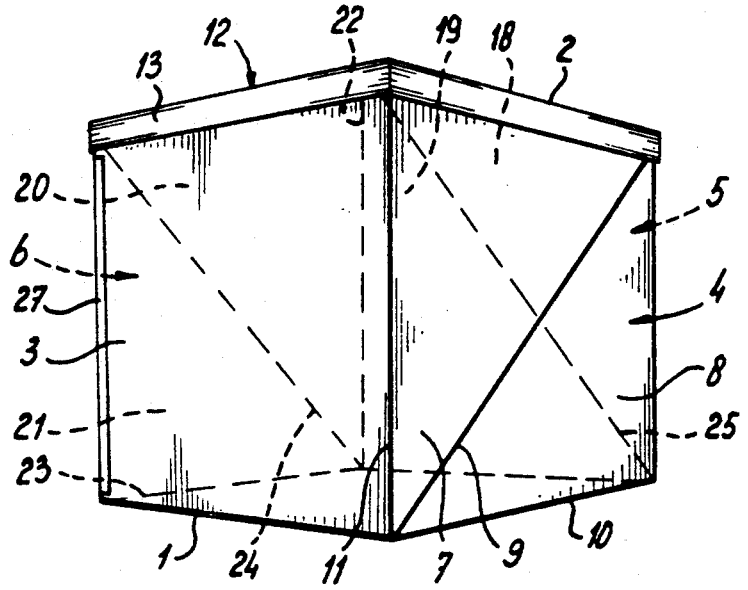
FIG. 1 shows a first embodiment of the container, opened out.

The container shown in FIG. 1 is cube-shaped, and comprises in the known manner a bottom panel 1, a loose lid 2, and four side walls 3, 4 (visible) and 5, 6 (not visible). One side wall, as shown, is made up of a square panel, while the other side walls are made up of triangular panels. Thus side wall 4 comprises the triangular panels 7 and 8, which are interconnected by means of a hinge line 9. The triangular panel 8 is also connected by means of hinge 10 to the bottom panel, while triangular panel 7 is connected by means of hinge 11 to the panel 3. The latter is further not connected to the bottom panel 1. Finally, the lid 12 is placed on the container, its edge 13 enclosing the top edge of the container walls.

Figure 2:
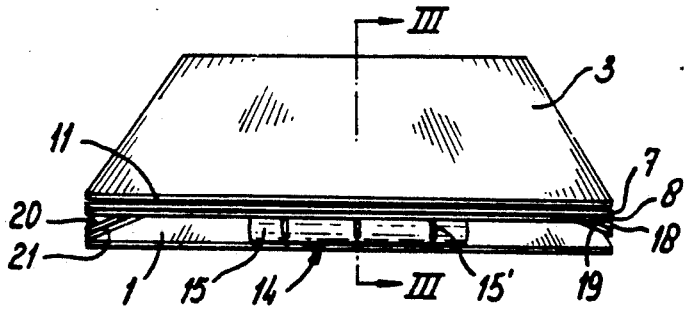
FIG. 2 shows a view of this container in the collapsed position.

As shown in FIG. 2, in the collapsed position of the container the panel 3 is situated on top of the walls collapsed into each other. The bottom panel 1 is at the bottom side. The edges of the other walls can be seen between these. A hinge design 14, which will be explained in greater detail later, is also shown.

Figure 3:
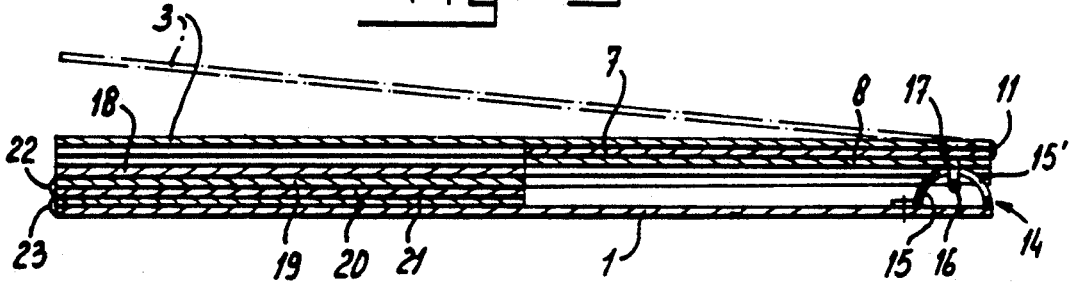
FIG. 3 shows cross-section III—III of FIG. 2.

In the cross-section shown in FIG. 3 the panel 3 and the bottom wall 1 can also be seen. The panel 3 is shown in dashed lines in the position in which it is opened out first when the container is being erected. The hinge 11, by means of which the panel 3 is connected to the triangular panel 7, is also shown. This triangular panel 7 is folded onto the triangular panel 8, which is connected by means of the hinge device 14 to the bottom panel 1. As can be seen, the hinge device 14 is made up of a semi-cylindrical tube 15, which has a number of slots 15' in the peripheral direction. A corresponding pin 17, which is fixed in the triangular panel 8, projects into these slots in each case, the end projecting through the slots 15' into the tube 15 being provided with a thickened part 18, in such a way that the panel 8 is retained. This panel 8 can now make a swinging movement about the imaginary centre point of the circle determined by the tube 14, in such a way that in the collapsed position it comes to lie at a level corresponding to half the diameter of the tube 15 above the bottom panel 1. The half diameter of tube 15 is now selected in such a way that below the triangular panel 8 the other triangular panels 18, 19, 20 and 21 can find space folded on top of each other. The hinges 22 and 23, by means of which said panels are connected to each other, can also be seen. All this will be explained further with reference to FIGS. 4*a* to 4*d*.

Figure 4A:
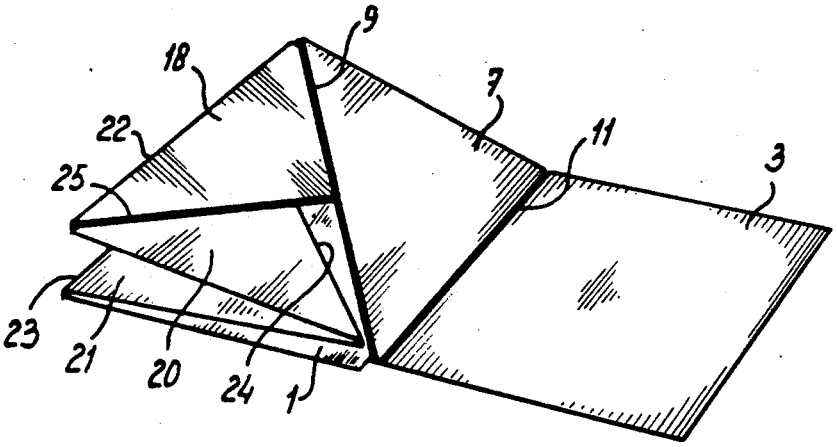
FIG. 4*a* shows the first phase of opening out the container.

In FIG. 4*a* wall 3 is folded away from the other walls. The triangular panels together forming the walls 4, 5 and 6 are also lifted away a little from the bottom panel 1. The triangular wall panels 21 and 20, together forming wall 6, therefore now no longer run parallel, but form a slight angle relative to each other. The same applies to the triangular panels 18 and 19 (not visible) which together form the wall 5, and to the triangular panels 7 and 8 (not visible) together forming the wall 4.

The triangular panel 21 now hinges about hinge line 23 relative to the bottom panel 1, and about the diagonally running hinge line 24 relative to triangular panel 20. The latter in turn hinges by means of hinge line 22 relative to the triangular panel 19 (not visible), while triangular panel 19 itself hinges by means of the diagonally running hinge line 25 relative to triangular panel 18. Finally, triangular panel 18 is fixed by means of hinge line 9 to triangular panel 7.

Figure 4B:
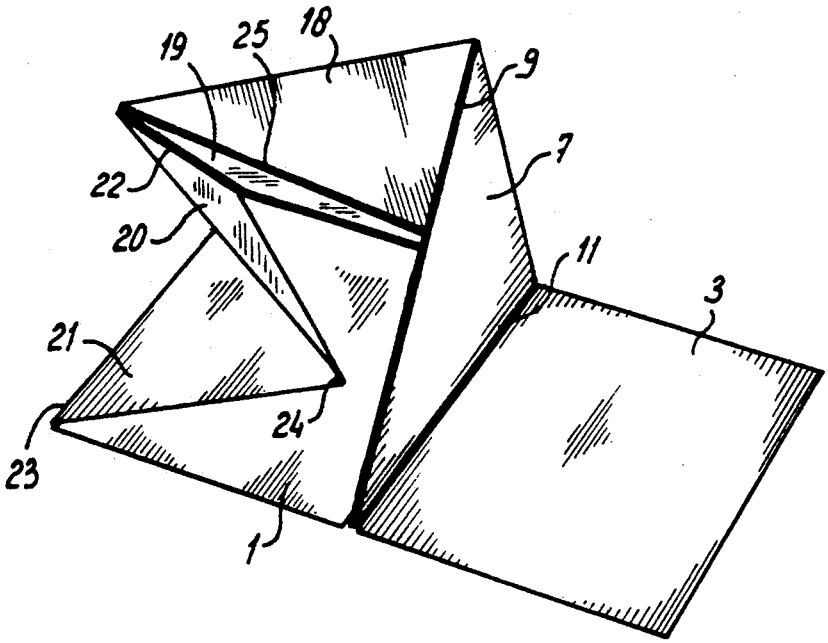
FIG. 4*b* shows the second phase of opening out the container.
Figure 4C:
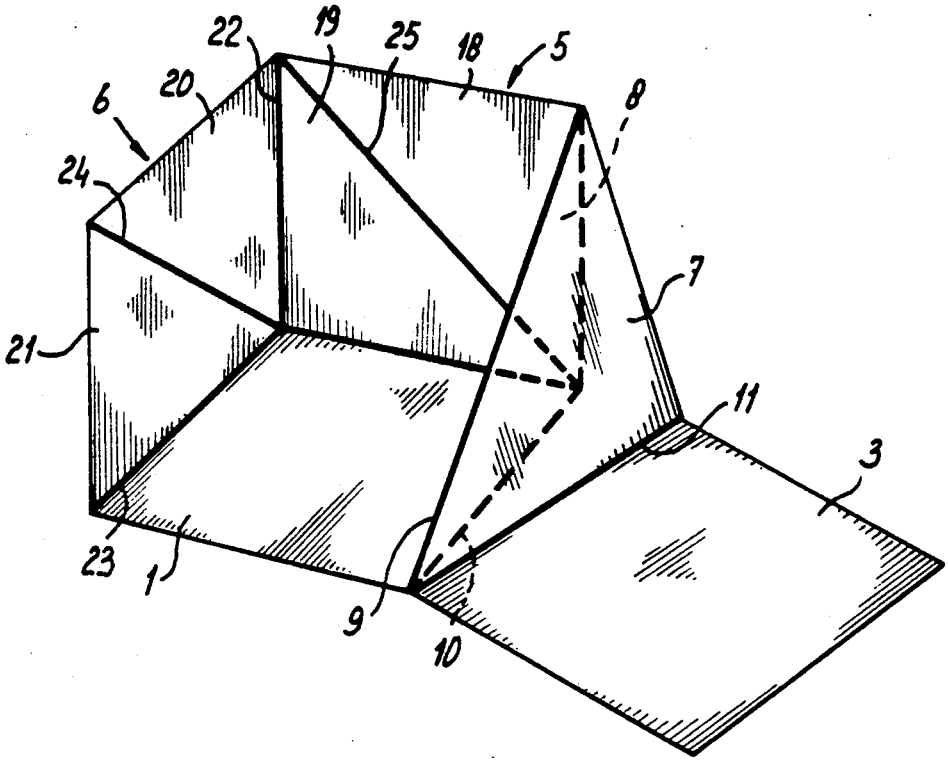
FIG. 4*c* shows the third phase of opening out the container.
Figure 4D:
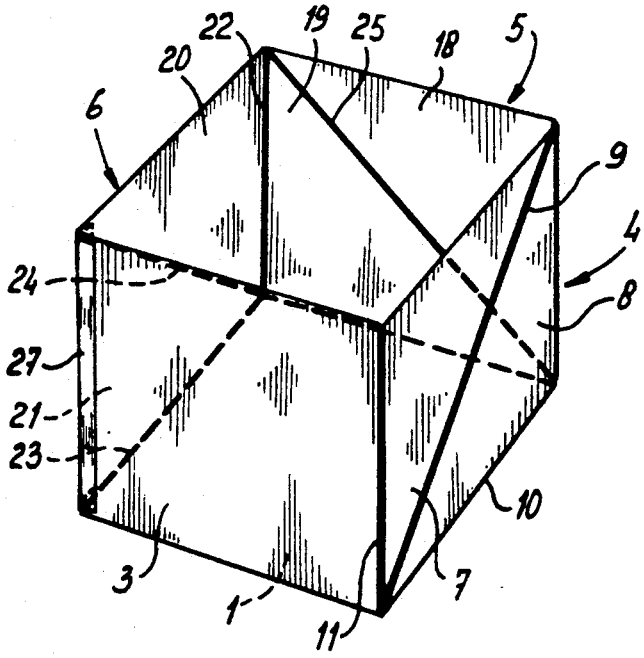
FIG. 4*d* shows the fourth phase of opening out the container.

The action of opening out, described above with reference to FIG. 4*a*, is developed a little further in FIG. 4*b*. Triangular panel 7 (and also triangular panel 8, which is not visible) are now virtually upright, while the other triangular panels 18, 19, 20 and 21 are also raised further. On proceeding further with the opening-out action, the position shown in FIG. 4*c* is reached, in which position the triangular panels 21 and 20 and 18 and 19 form the walls 6 and 5 respectively of the container. From this position shown in FIG. 4*c* the container is then completed by turning triangular panel 7 about the diagonally running hinge line 9 relative to triangular panel 8, in such a way that the wall 3 with its free edge comes to rest against the free edge of the triangular panel 21. The wall 3 and the triangular panel 21 can be fixed to each other by means of a fixing element 27. This fixing element 27 can be, for example, an adhesive strip or a velcro strip.

It is also pointed out that triangular panel 19 is not connected to the bottom 1, so that in the collapsed position of the container it can come to rest a distance from the bottom panel 1 on top of the triangular panels 21 and 20. It is possible per se also to fix the panel 19 hingedly to the bottom 1 by means of a suitable hinge.

Figure 5:
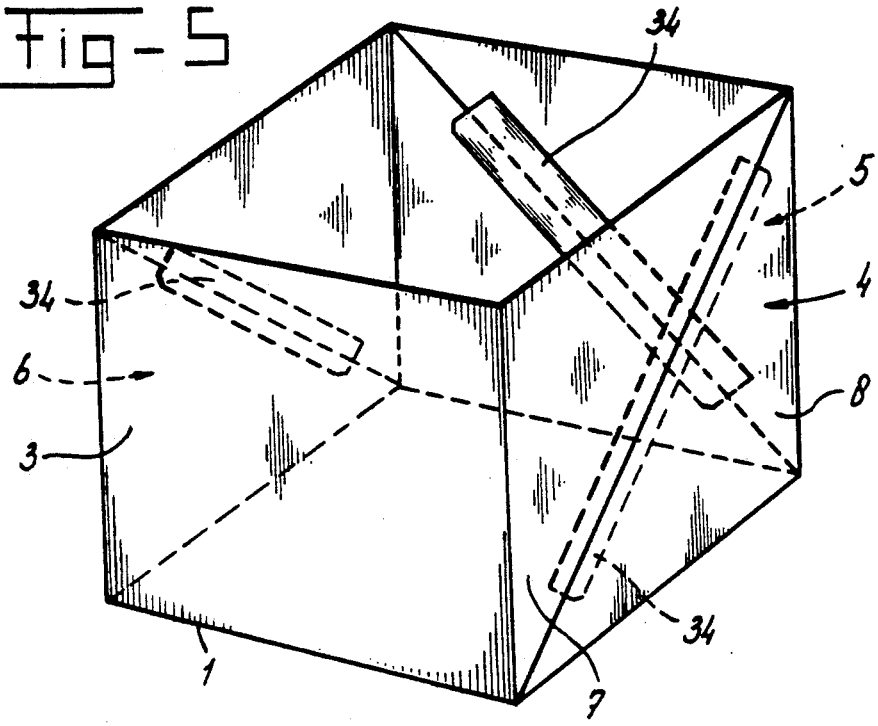
FIG. 5 shows a variant of the container according to FIG. 1.

A variant of the container of the embodiment according to FIG. 1 is described in FIG. 5.

In this case the lid is omitted, for the sake of clarity. According to this embodiment, the side walls 4, 5 and 6 are also constructed of triangular panels, i.e. 7, 8 for, for example, side wall 4. A strip 34 is now fixed on one of the triangular panels, for example 5, seen on the inside in FIG. 8. This strip projects relative to the hinge line 9 by which the triangular panels 7 and 8 are connected to each other. This means that when the container is fully opened out and the triangular panels 7, 8 are in line with each other the projecting part of strip 34 rests against the inside of the triangular panel 7. In this way the triangular panels 7, 8 are prevented from pivoting through further than desired relative to each other, as a result of which the side wall 4 would become bulged. When the walls are of a certain thickness, the strip 34 can be fitted in such a way that it does not project in the thickness direction relative to the triangular panel 8. A correspondingly shaped recess could be provided in the triangular panel 8, in such a way that when the container is fully opened out the strip 34 lies in the same plane as the inside of the side wall.

Figure 6:
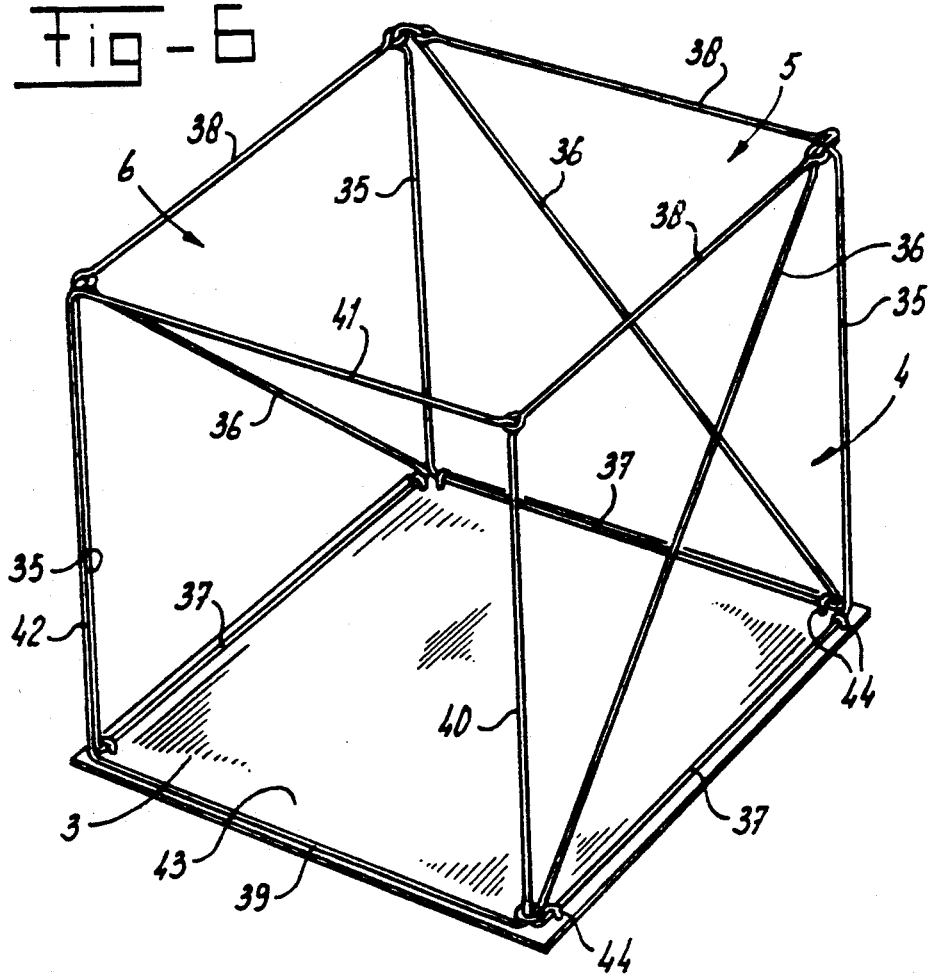
FIG. 6 shows a second embodiment of the container.

In the second embodiment of the container shown in FIG. 6, it comprises sections in the form of bars 35 with a round cross-section. Three bars 35, 36 and 37 are here in each case combined to form one rigid triangle which is, for example, comparable to the triangular panel 8 according to FIG. 1 or FIG. 5. The corresponding triangular panels of the walls 5 and 6 are made up of the same bars 35, 36 and 37. As shown in FIG. 6, sections 38 are also provided. With them, the apexes determined by the connecting point of the sections 35 and 36 are in each case hingedly connected to each other. Finally, a square consisting of four bars 39, 40, 41 and 42 is formed, said square also being connected to a top corner point by a section 38. When the container according to FIG. 6 is erected, section 42 rests against section 35.

As can be seen in FIG. 6, the walls 4, 5, 6 are hingedly connected to the bottom panel 43 by, for example, staples 44. The collapsing and opening out of this embodiment of the container takes place in the same manner as shown in FIGS. 1 to 4*d*. Fitting the bars 37 with the required play in the staples 44 ensures that the walls can be stacked on top of each other during folding up, entirely corresponding to the first embodiment.

A certain type of material can, of course, be stretched between the faces determined by the sections. It can be, for example, supple material such as plastic or fabric. It is, of course, also possible to fit rigid material such as wood or metal panels.

I claim:

1. A collapsible parallelepipedic container having a bottom panel (1) which is hingedly connected to one of three hingedly interconnected side faces (4–6) which are collapsible onto said bottom panel (1), each of said three hingedly interconnected side faces being composed of face halves (7, 8) which are hingedly interconnected along a diagonal hinge (9, 24, 25) in such a way that said side faces (4–6) are foldable with respect to said diagonal hinges (9, 24, 25), whereby the diagonal hinge lines of any two neighbouring faces (4–6) do not meet at their respective end, and having a fourth rigid side face (3) which is hingedly connected (11) to one of said three side faces (4–6) and which at its opposite edge is detachably connected (27) to the corresponding free opposite edge of another of said faces.

2. Container according to claim 1, wherein at least one of the three foldable faces (4–6) is provided on the inside with a stop (34) which is provided on one face part (7) and projects relative to the appropriate diagonal (9), and which in the position of the face halves in which they form one plane rests against the other face half (8).

3. Container according to claim 2, wherein the fourth face (3) at its opposite edge is provided with a fixing strip (27) extending along the free edge of said face (3), said fixing strip being fixable to the said corresponding side face of said opposite side faces (4–6).

4. Container according to claim 1, wherein the faces (4–6) consist of a framework comprising sections at the face edges.

5. Container according to claim 1, wherein fold lines of the edges of the panels and the diagonal fold lines are embodied by a framework.

* * * * *